US006966531B2

(12) United States Patent
Curtin

(10) Patent No.: US 6,966,531 B2
(45) Date of Patent: Nov. 22, 2005

(54) ROOF ANCHORS

(76) Inventor: James Laurence Curtin, 68 ST. George Crescent, Sydney, New South Wales (AU) 2171

( * ) Notice: Subject to any disclaimer, the term of this patent is extended or adjusted under 35 U.S.C. 154(b) by 400 days.

(21) Appl. No.: 10/204,860

(22) PCT Filed: Dec. 3, 2001

(86) PCT No.: PCT/AU01/01556

§ 371 (c)(1),
(2), (4) Date: Aug. 21, 2002

(87) PCT Pub. No.: WO02/48480

PCT Pub. Date: Jun. 20, 2002

(65) Prior Publication Data

US 2004/0035993 A1 Feb. 26, 2004

(51) Int. Cl.[7] ..... E06B 7/28; E06C 7/18; E04G 1/36

(52) U.S. Cl. ..... 248/237; 182/3; 182/45; 52/698

(58) Field of Search ..... 248/237; 182/45, 182/3; 52/713, 27, 698, 148, 152; 269/43, 269/46, 154, 258; 294/102.1, 85; 24/455, 24/457, 485

(56) References Cited

U.S. PATENT DOCUMENTS

| | | | | |
|---|---|---|---|---|
| 2,693,386 | A * | 11/1954 | Renfroe | 294/92 |
| 4,606,430 | A * | 8/1986 | Roby et al. | 182/3 |
| 4,932,185 | A * | 6/1990 | Lebel | 52/704 |
| 5,271,481 | A * | 12/1993 | Rich | 182/3 |
| 5,346,036 | A * | 9/1994 | Arisman et al. | 182/3 |
| 5,370,202 | A * | 12/1994 | Nichols | 182/3 |
| 5,553,685 | A * | 9/1996 | Cook | 182/45 |
| 5,687,535 | A * | 11/1997 | Rohlf | 52/713 |
| 5,727,646 | A * | 3/1998 | Gray | 182/45 |
| 5,730,407 | A * | 3/1998 | Ostrobrod | 248/237 |
| 6,298,629 | B1 * | 10/2001 | Ador | 52/698 |

FOREIGN PATENT DOCUMENTS

GB 2251020 A * 6/1992

* cited by examiner

*Primary Examiner*—Anita M. King
(74) *Attorney, Agent, or Firm*—Jacobson and Johnson

(57) ABSTRACT

There is an anchor for securing a working line (54) to a structure. The anchor includes a sole plate (2) with an attachment (19) for the working line (54). There is at least one friction plate (5) and a connector strap (4). In use of the anchor the sole plate (2) and friction plate (5) are located against respective opposite sides of a rafter (3) of the structure and are linked together by the strap (4) in a manner such that the working line load on the sole plate (2) generates a clamping force between the sole plate (2) and the friction plate (5). This force resists movement of the anchor by gripping only the outside of the rafter (3).

9 Claims, 11 Drawing Sheets

ROOF ANCHORS

FIELD OF THE INVENTION

This invention relates to height safety equipment. More particularly although not exclusively it discloses an improved roof anchor and clamping system for use on timber rafters, trusses or other suitable members.

BACKGROUND OF THE INVENTION

The need for safety systems for people working at heights has long been recognised. Fall-arrest systems have been devised to protect workers in situations where they would otherwise be exposed to risk of serious injury or death by falling. Fall-arrest systems are a means by which the worker is attached to a secure point on the underlying structure. An integral part of any fall-arrest system is the anchorage point to the underlying structure. Both the anchor point and the underlying structure should be capable of sustaining the forces that may be imposed when arresting a fall with a wide margin of safety. It is essential that the anchor point and its means of attachment to the underlying structure do not interfere with the ability of the underlying structure to carry its load requirements. In the building industry timber roof frames are typically constructed of pre-assembled trusses. In many cases the drilling of holes and placement of bolts in the truss/rafter member may lead to structural weakening and inability of the truss/rafter to carry its load requirements. In particular, the truss/rafter may be unable to sustain the forces imposed in arresting a fall because of such weakening. All of the anchor points designed to date rely on penetration of rafter/truss members or other timber members by nails, screws or bolts through a rigid plate system as an integral means of support. These penetrations and plates may weaken the timber unacceptably.

OBJECTS OF THE INVENTION

One of the objects of the present invention is to provide an anchor point of attachment to the underlying structure which meets stringent government standards, minimises impact on the underlying structure and maintains a high degree of safety for workers. The unique clamping mechanism of the present invention has several features that enable it to meet this objective. Firstly, the anchor is attached to the rafter/truss member without relying on any strength reducing penetration of the member. Secondly, the load is spread out along the rafter/truss thereby minimising the impact on the underlying member.

A second object of the present invention is to provide an anchoring means that can be installed conveniently and quickly in standard roof construction. The anchor may be sized to conform to the dimensions of any timber suitable for framing roofs. In addition the anchor can be attached to a rafter/truss at almost any location on a roof. The user can also install the anchor without special equipment. In addition, the anchor cain be easily removed for re-use.

Fall-arrest systems usually include elements that should be replaced or inspected after they have been used to arrest a fall. To minimise the risk of overlooking impairment of the system caused by heavy loading during a fall it is desirable to provide a clear permanent indication that the fall-arrest system has been loaded. Therefore, a third object of the present invention is to provide a clear, permanent indication that the fall-arrest system has been loaded.

SUMMARY OF THE INVENTION

Accordingly an anchor for securing a working line to a structure is disclosed, said anchor including a sole plate adapted for attachment to said working line, at least one friction plate and a connector means whereby in use of the anchor the sole and friction plates are located against respective opposite sides of a member of said structure and are linked together by said connector means in a manner such that a working line load on the sole plate generates a clamping forces between said sole plate and friction plate which resists movement of the anchor by gripping only the outside of said member without any strength reducing penetration thereof.

Preferably the sole plate includes an eye bolt for attachment of the working line.

It is further preferred that the eye bolt is of one piece construction.

It is further preferred that the eye bolt is adapted for plastic deformation to absorb impact loading and provide visual evidence of said loading.

It is further preferred that the friction plate is formed with transverse teeth or grooves to facilitate gripping of the member.

BRIEF DESCRIPTION OF THE DRAWINGS

The currently preferred embodiments of the invention will now be described with reference to the attached drawings in which:—

DETAILED DESCRIPTION OF THE PREFERRED EMBODIMENTS

Figure 1:
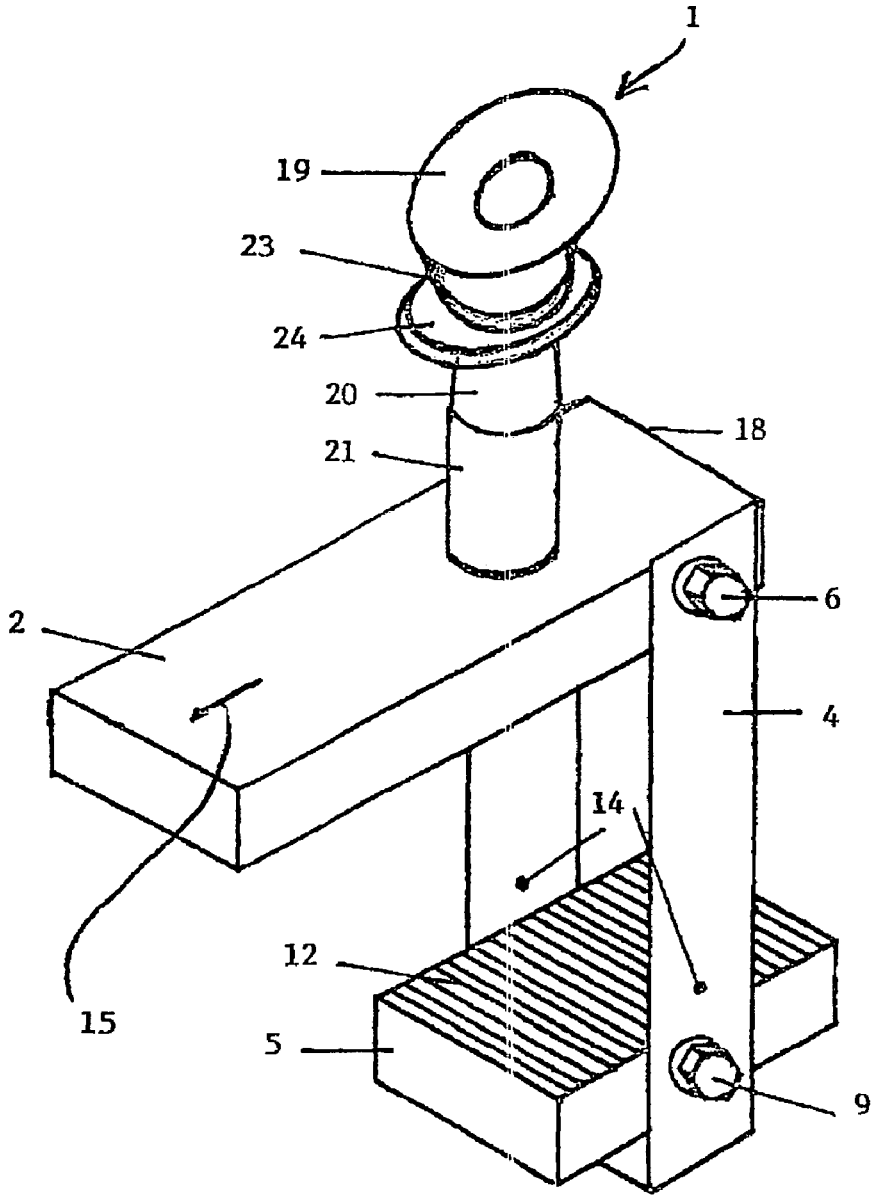
FIG. 1 is a perspective view of a first embodiment of an anchor according to the invention.
Figure 2:
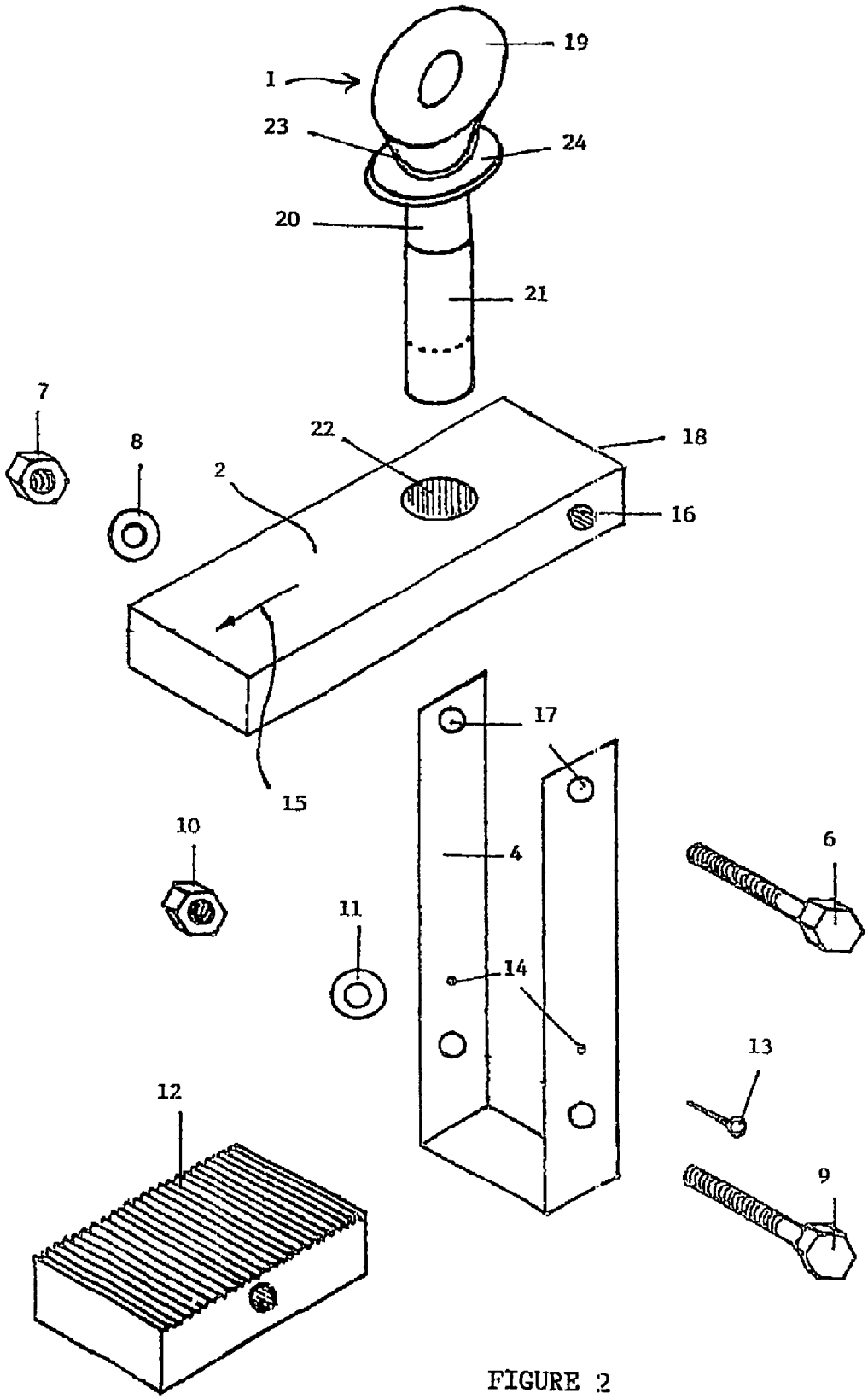
FIG. 2 is an exploded view of the anchor of FIG. 1.

In the first embodiment of the invention shown in FIGS. 1, 2, 5 and 7 the anchor and clamping system comprise an eyebolt 1 (for attachment of a working or safety line) which is welded into a sole plate 2 that is clamped to the rafter/truss 3 by means of a U strap 4 and friction plate 5. The U strap is connected to the sole plate by means of a bolt 6 that passes through the U strap and sole plate. The bolt is secured with a nut 7 and washer 8. The friction plate 5 is connected to the U strap 4 by means of a second bolt 9 that passes through the U strap and the friction plate. This bolt is secured in place with a nut 10 and a washer 11. The top surface of the friction plate preferably has toothed grooves 12 that contact the underside rafter/truss to prevent movement of the friction plate. A small clout 13 is also preferably passed through the preformed clout aperture 14 in the U strap to assist in locating the anchor in the desired position.

Figure 5:
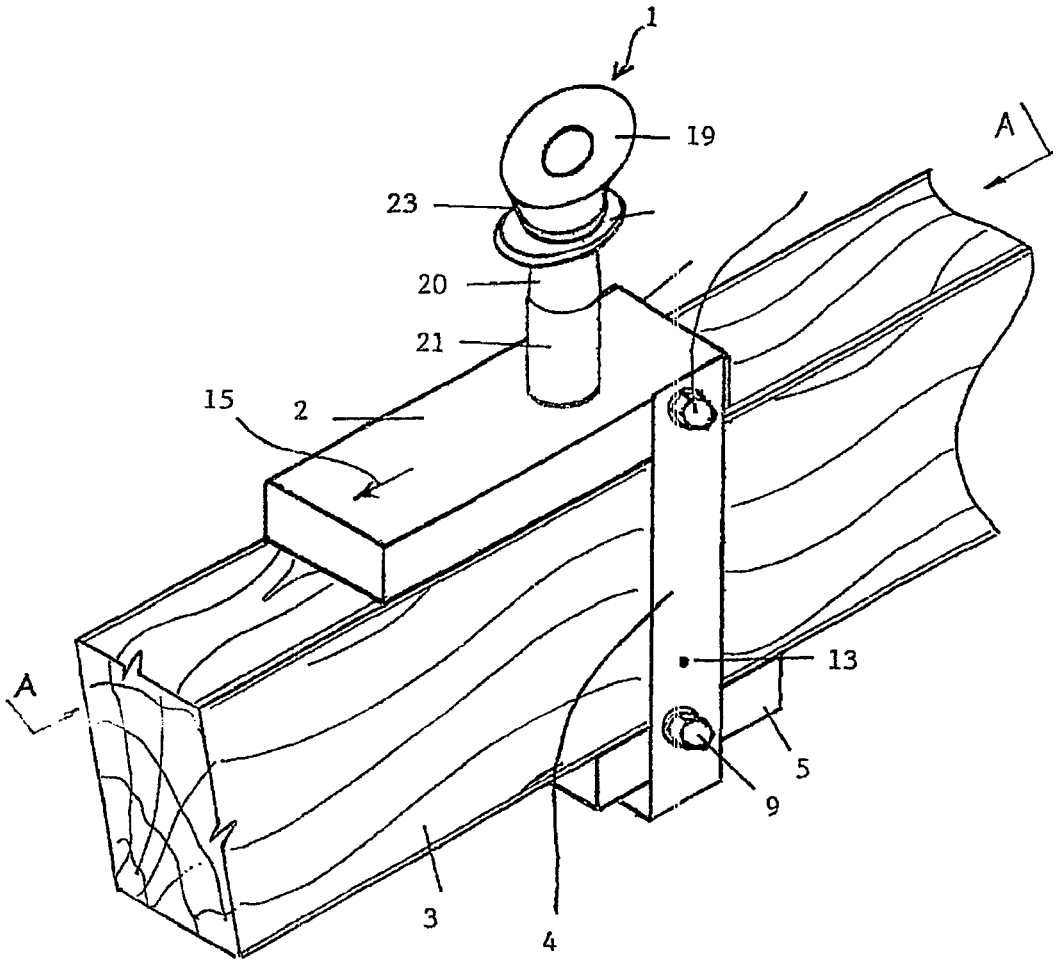
FIG. 5 is a perspective view of the anchor of FIG. 1 installed on a rafter/truss.

FIG. 5 shows the anchor of FIG. 1 fitted to a rafter/truss 3. To install the anchor the bolt 6 is removed from the sole plate 2. The U strap 4 with friction plate 5 attached is slid squarely onto the rafter/truss from the underside so that the friction plate abuts the underside thereof. It is important that the toothed grooves of the friction plate be in contact with the underside of the rafter/truss. The sole plate 2 is placed on the upper surface of the rafter/truss so that the arrow 15 is pointing in the direction of intended loading and the bolt hole 16 of the sole plate lines up with the bolt holes 17 of the U strap. The U strap 4 is then connected to the sole plate by passing the bolt 6 through the bolt holes in the U strap and the sole plate and held in place with thee nut and washer. The sole plate is then tapped on the rear surface 18 in order to tension the clamping mechanism of the U strap and friction plate. The locating clout 13 is passed through the aperture in the U strap to assist in locating the U strap and friction plate in the desired position.

When loading force is applied to the eyebolt 1 a clamping action is generated between the sole plate 2 and the friction plate 5. The loading force can the eyebolt pulls the eyebolt and sole plate in the direction of load. The force is also transmitted via the U strap 4 to the friction plate 5. The force on the friction plate increases the clamping action on the rafter/truss 3. This clamping action allows both plates to stay parallel with the plane of the rafter/truss and minimises any adverse loads on this member when arresting a fall.

The eyebolt 1 is preferably forged out of 316 stainless steel and is of one piece construction. It consists of a ring 19 to which the safety or working line is attached and a rod with a tapered section 20 and a parallel section 21. Preferably the smaller end of the tapered section is adjacent to the ring. The parallel section of the eyebolt is press fitted into the sole plate and is then plug welded to the arris 22 of the sole plate. In addition, forged into the eyebolt is a raised locating lip 23 to assist in positioning the rubber flashing sheath 24. Under heavy loads, as when arresting a fall, the rod of the eyebolt will undergo plastic deformation. This plastic deformation is initiated at the eyebolt segment 21 of constant cross-section. This plastic deformation has two purposes. Firstly it provided a clear visual indication that the system has been significantly loaded, thus indicating that part or all of the system may need replacing prior to further use. Secondly the plastic deformation will contribute to shock absorption at high loads.

A number of the dimensions are variable to suit different applications of the anchor. The dimensions of the sole plate, U strap and friction plate can be varied to suit rafters/trusses of varying size. In addition the length of the parallel section of the eyebolt can be varied to cater for differing roof coverings. Such variations may be necessary if the eyebolt is to be used after batons and tiles have been placed above the rafter/truss.

Figure 7:
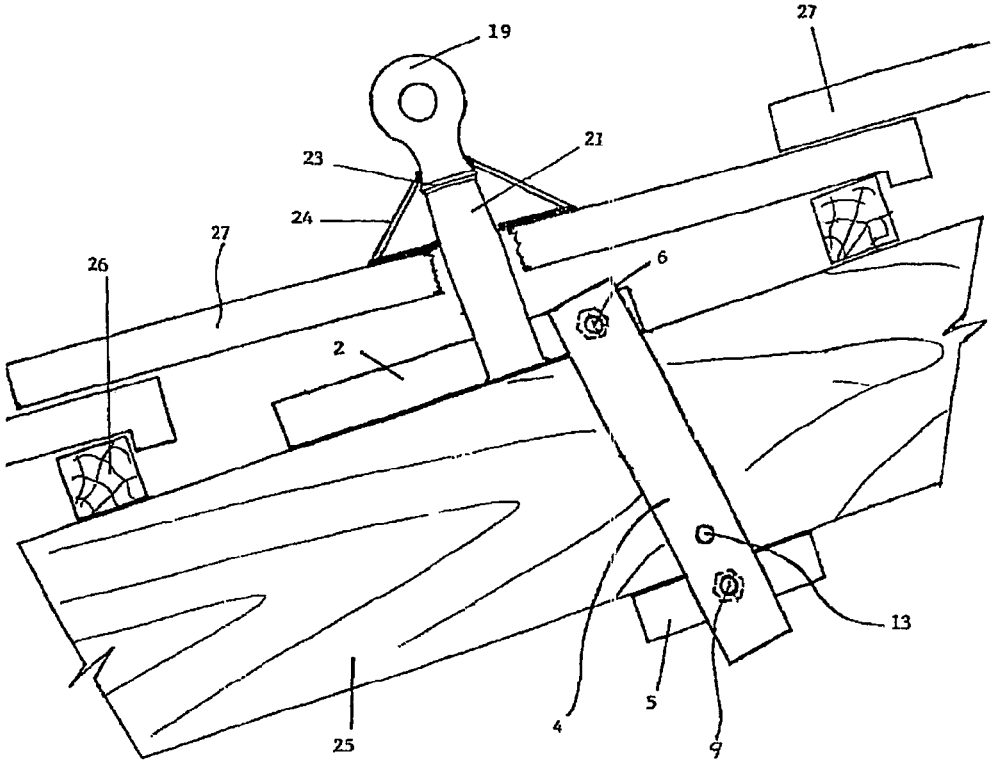
FIG. 7 is a cross-sectional view along the lines A—A of FIG. 5.

FIG. 7 shows the anchor of FIG. 1, fitted to a rafter/truss 25 that has batons 26 and tiles 27 in place. The parallel segment 21 of the eyebolt has been extended so that the ring 19 projects well clear of the tiles. The rubber flashing sheath 24 is shown in position around the locating lip 23 of the eyebolt and is sealed to the tiles. This sheath provides a weather seal and prevents water damage to the rafter/truss.

Figure 3:
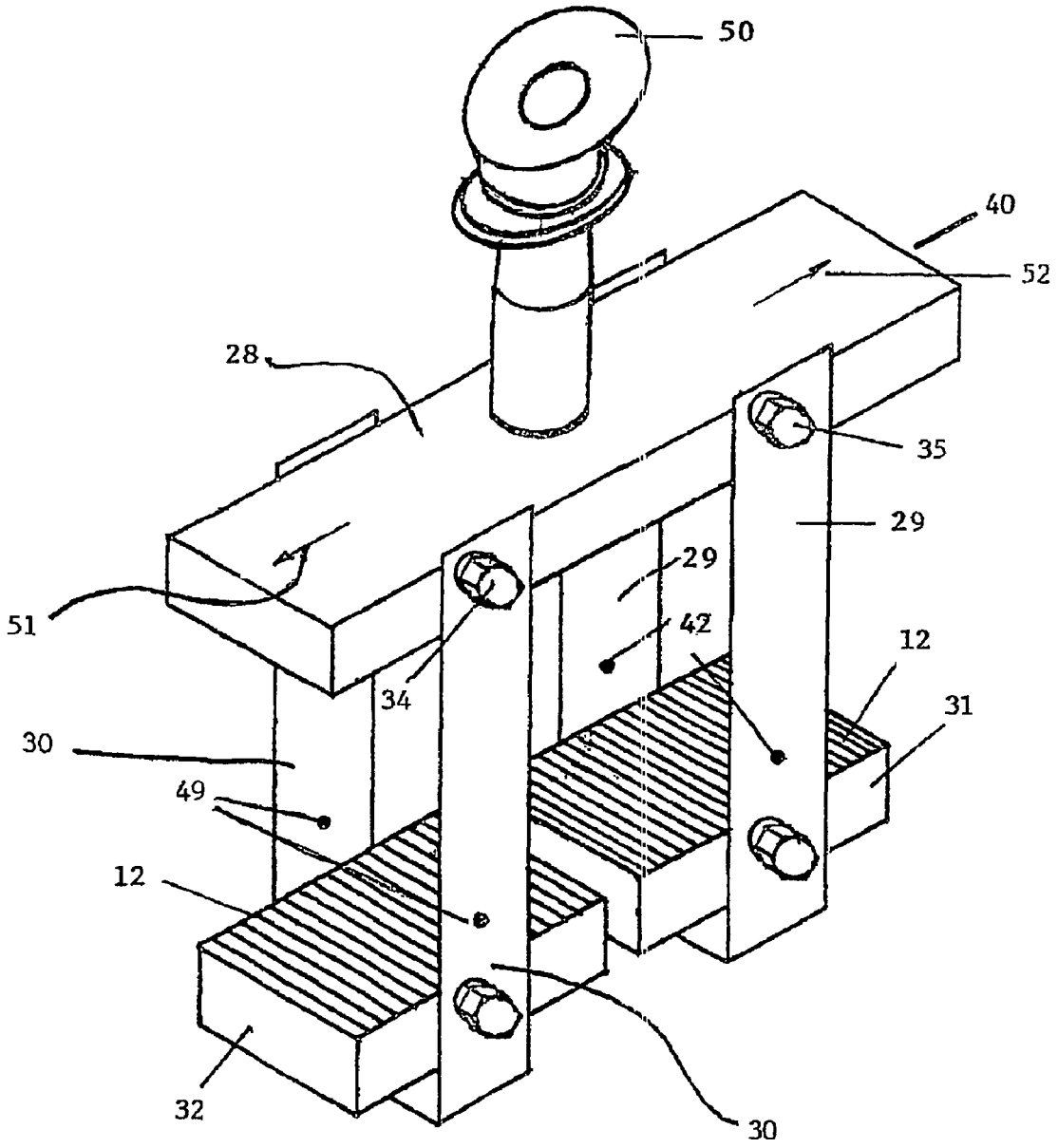
FIG. 3 is a perspective view of a second embodiment of an anchor having two friction plates.
Figure 4:
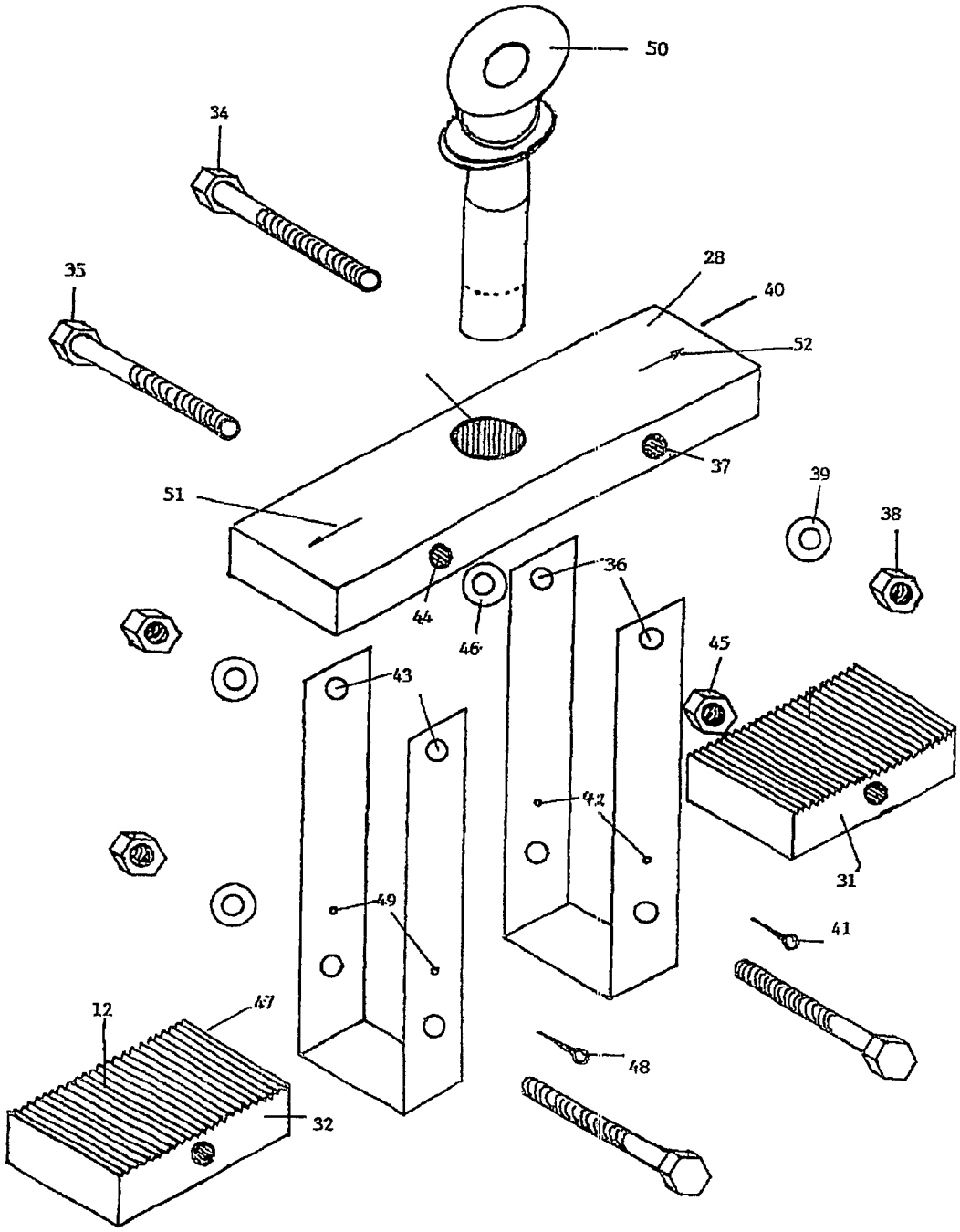
FIG. 4 is an exploded view of the anchor of FIG. 3.
Figure 6:
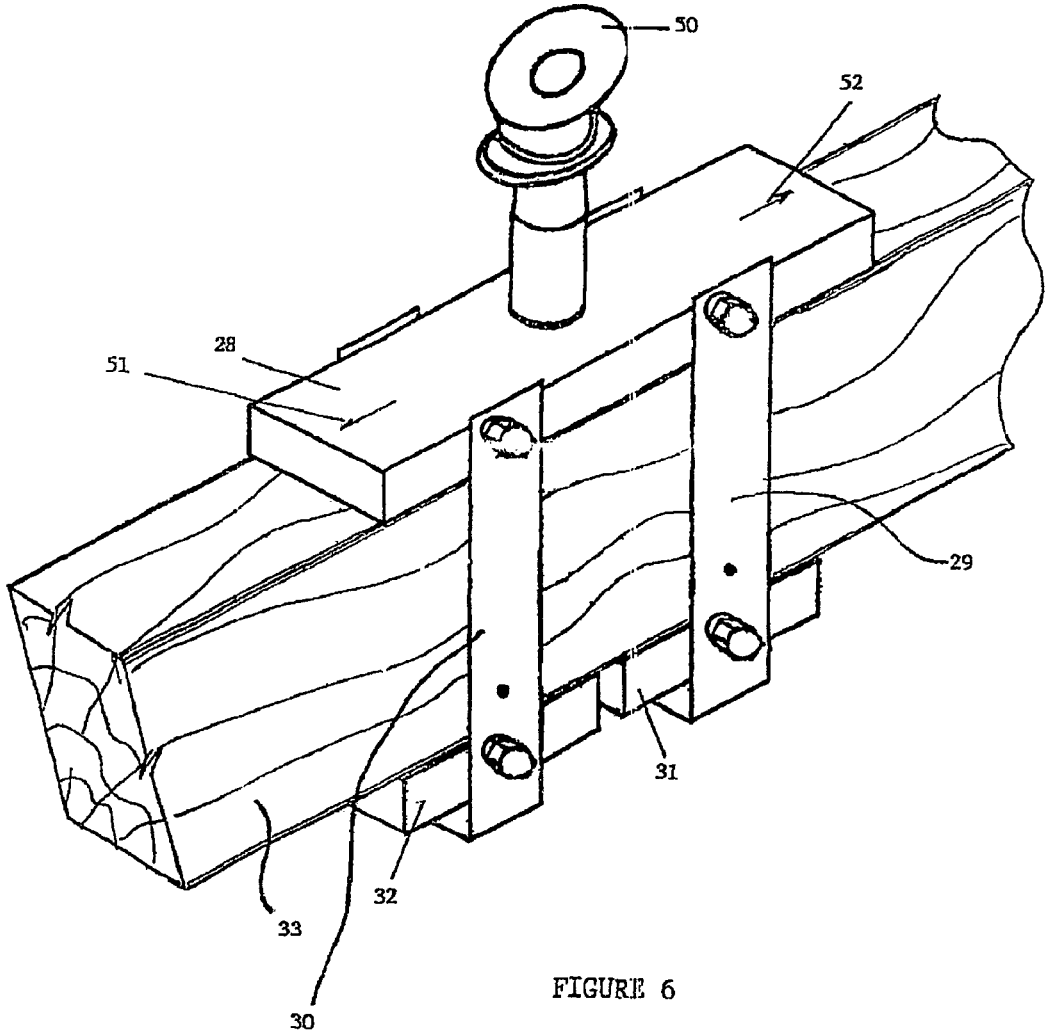
FIG. 6 is a perspective view of the anchor of FIG. 3 installed on a rafter/truss.

It is intended that the anchor of FIG. 1 be for temporary use. The second embodiment of the invention as shown in FIGS. 3, 4 and 6 is intended for bi-directional use and may be permanently installed on a roof. This version has a dual clamping action allowing loading in either direction. The sole plate 28 is extended in length and a pair of U straps 29, 30 and friction plates 31,32 are attached. These U-straps and friction plates are similar to the U strap and friction plate described earlier with the first embodiment.

FIG. 6 shows the second embodiment installed on a rafter/truss 33. To install this anchor the two bolts 34. 35 connecting the U straps to the sole plate are removed. The sole plate is then positioned on the rafter/truss in the desired location. The U-strap 29 with friction plate 31 attached is then slid squarely onto the rafter/truss from the underside so that the friction plate 31 abuts the under surface of the rafter/truss. The U strap 29 is positioned so that the bolt holes 36 in the U-strap line up with the bolt hole 37 in the sole plate. The U-strap is then connected to the sole plate by passing the bolt 34 through the U-strap and the sole plate and securing it with the nut 38 and washer 39. The sole plate is then tapped on the rear surface 40 in order to tension the clamping mechanism of the U-strap and friction plate. A small locating clout 41 is passed through the aperture 42 in the U-strap to assist in locating the U-strap and friction plate in the desired position. The second U-strap 30 and friction plate 32 is then slid squarely onto the rafter/truss from the underside so that the friction plate 32 abuts the under-surface of the rafter/truss. This second U-strap 30 is positioned so that the bolt holes 43 in the U-strap line up with the bolt hole 44 in the sole plate. The U-strap 30 is then connected to the sole plate by passing the bolt 35 through the U-strap and sole plate and securing it in place with the nut 45 and washer 46. To tension the clamping mechanism of the second U-strap it is necessary to separate the two friction plates 31, 32. This is achieved by tapping on the front surface 47 of the second friction plate 32 to push it away from the first friction plate 31. A small locating clout 48 is passed through the aperture 49 in the U-strap to assist in locating the second U-strap and friction plate in the desired position. Loading the eyebolt 50 in either direction as indicated by the directional arrows 51, 52 on the sole plate will tension the clamping mechanism of the appropriate U-strap and friction plate in a manner identical to the first embodiment.

Figure 8:
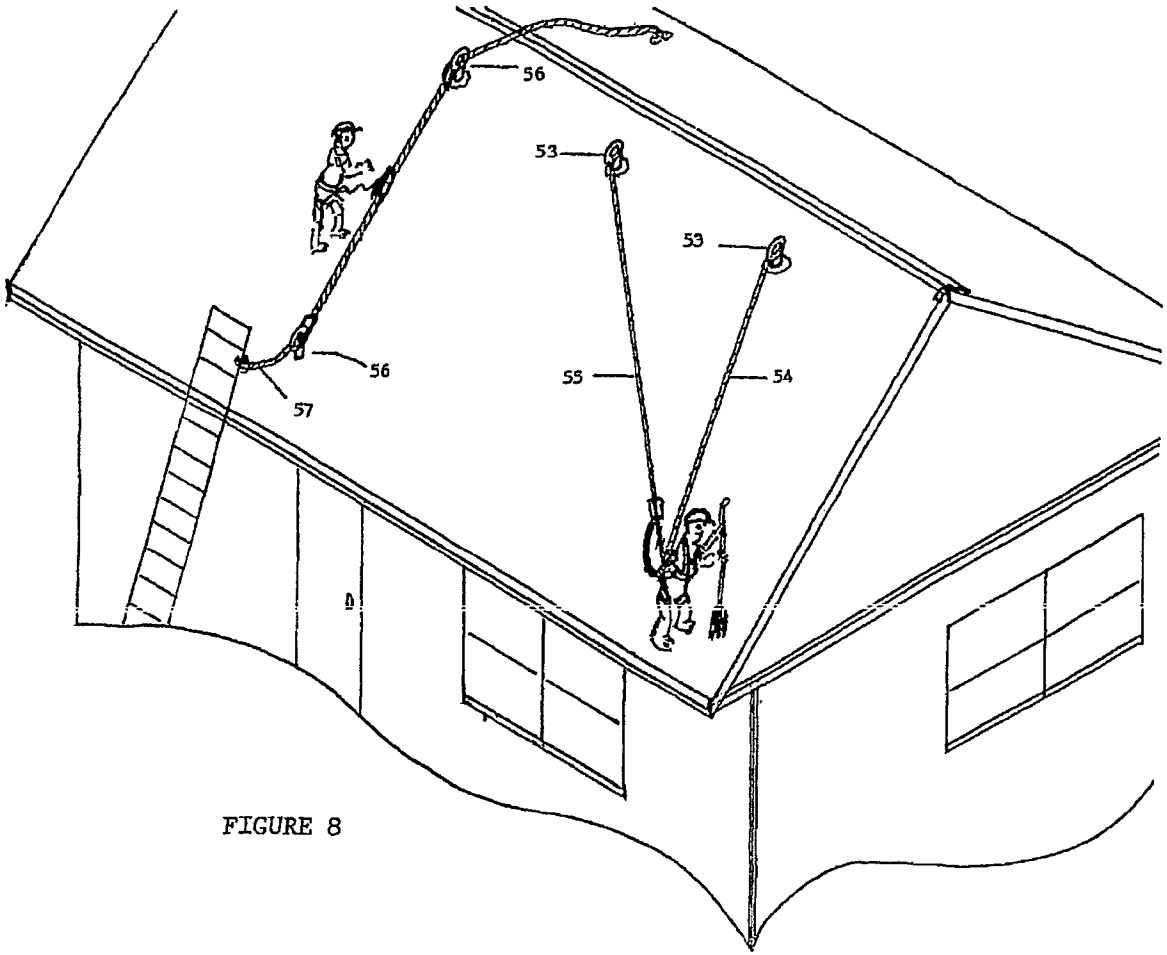
FIG. 8 is a schematic perspective view of a building showing the anchors in use.

FIG. 8 is a schematic perspective view showing anchors according to the first and second embodiments of this invention in use on a building roof. The first embodiment is the single action clamping system 53. The worker attached his working line 54 to this anchor. It is preferred that workers always have a second safety line 55 connected to a second anchor point. This second line has two purposes. Firstly it provides a back up in the event of failure of any component of the working line and secondly it reduces the pendulum effect in the event of a fall. The second embodiment is the dual action clamping system 56 that can be used bi-directionally. This anchor can be installed on one face of the roof and enable the worker to work either face of the roof. The worker may climb onto the roof by means of a ladder. The ladder is attached by a working line 57 to a dual action anchor that is fixed to the roof. A cable or rope may be connected to two dual action anchors 56 to provide a point of attachment for a worker's safety line. The worker may attach himself to the cable and move up the roof using a shunt or similar mechanism.

Figure 9:
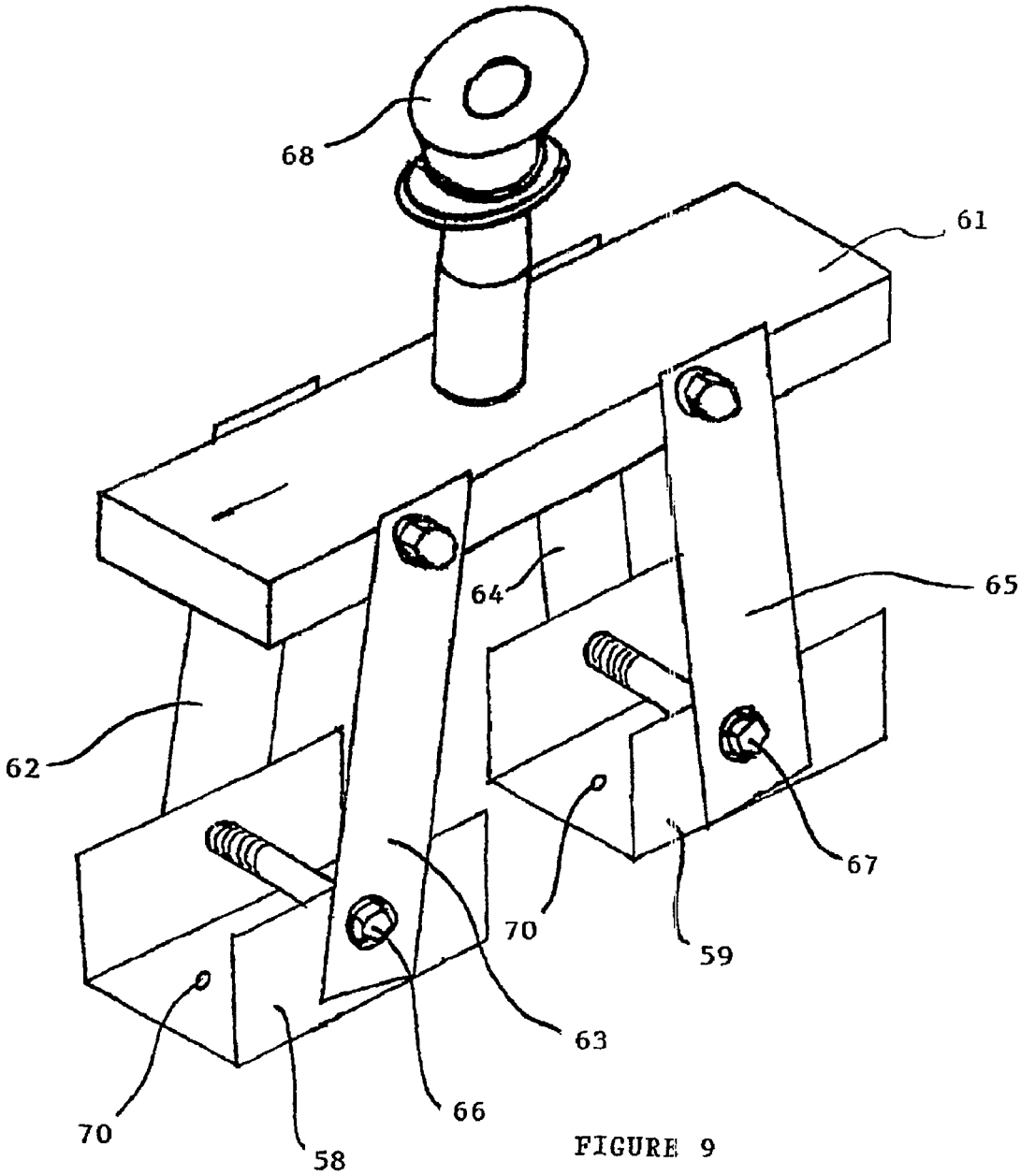
FIGS. 9, 10 and 11 show modified versions of the anchor of FIG. 3.
Figure 10:
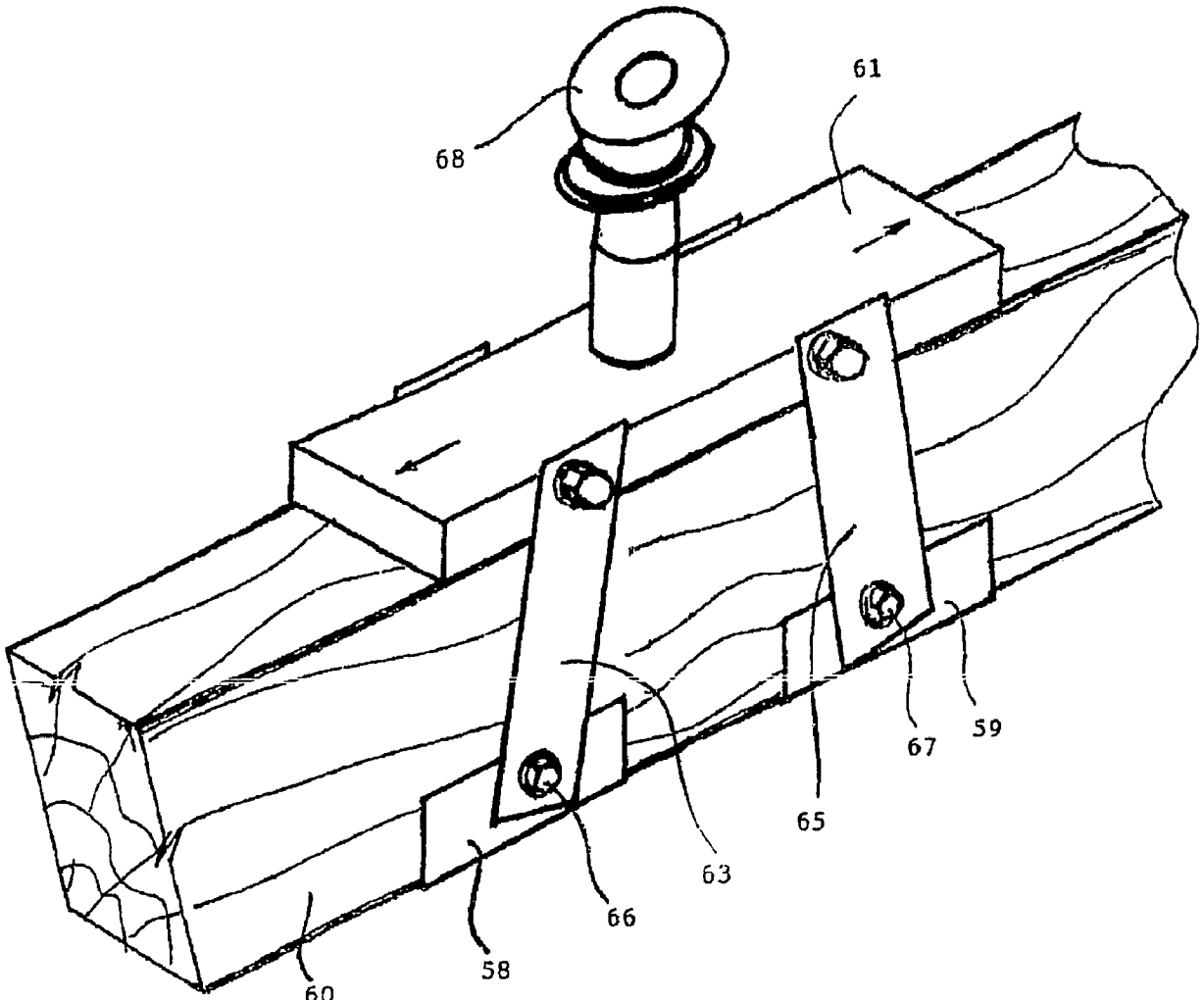

With structures having exposed interior roof beams a variation of the dual action anchor is shown in FIGS. 9 and 10. This anchor is primarily intended for permanent installation. The friction plate in this case comprises a pair of friction U straps 58, 59 located under the beam 60. These are hingedly connected to the sole plate 61 by pivot straps 62, 63, 64 and 65 on each side and bolts 66, 67. The bolts pass transversely through the lower portion of the beam and thus are not visible from the underside. The structure and operation of this version is basically the same as that described earlier with reference to FIGS. 3 and 6. When a loading force is applied to the eyebolt 68 it is pulled in the direction of the load and a clamping force is generated between the sole plate and the friction U straps by means of force transmission through the pivot straps.

Although not shown small locating clouts may also be driven upward through apertures 70 the friction U straps and into the underside of the beam.

While the bolts 66, 67 extend through the width of the beam 60 this is not to be considered a strength reducing penetration as the load is still applied to the beam by means of compression between the sole plate and friction U straps. No significant force is applied by the bolts directly to those immediately surrounding beam fibres.

Figure 11:
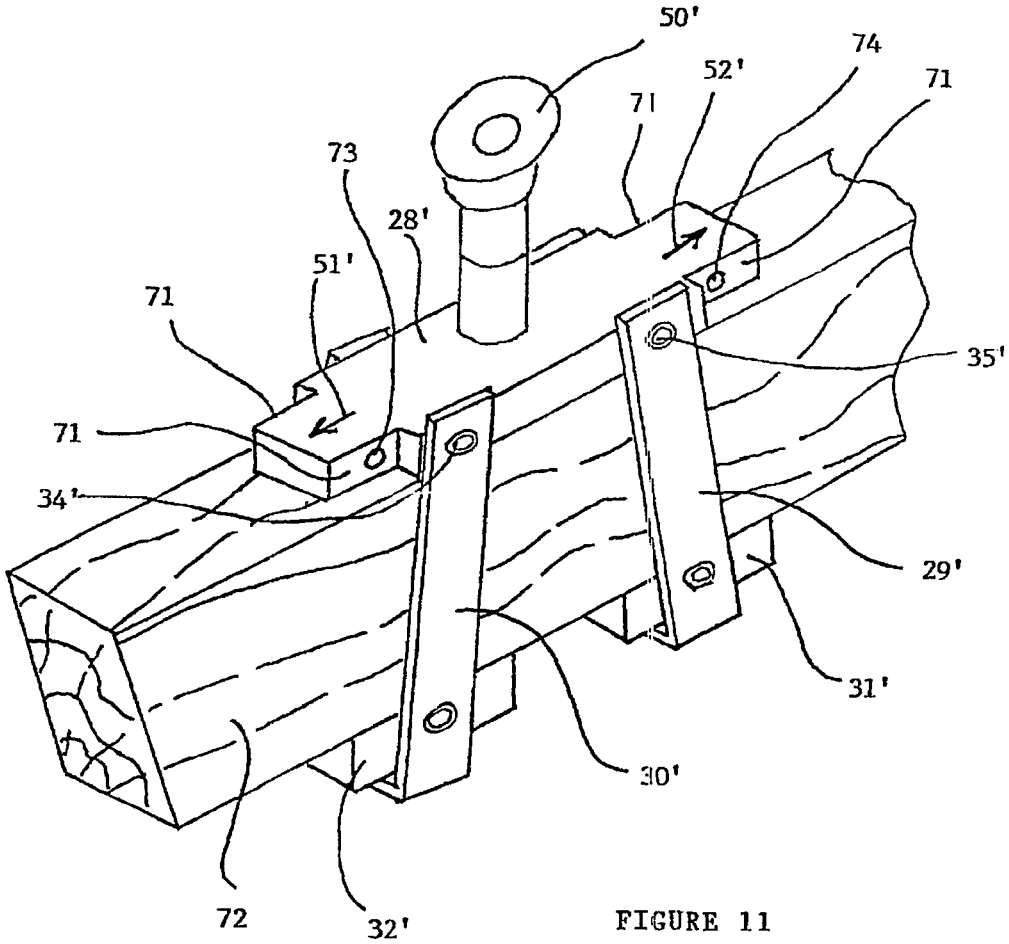

The version of the anchor shown in FIG. 11 operates in a similar manner to that of FIG. 3 and the main components corresponding in function are indicated by the same numbers which however are primed. (') to distinguish them. In this case the sole plate 28' has cutouts 71 at each end so as to fit different widths of rafter. Although the invention is not limited to any specific dimensions, these widths may for example be 35 mm and 50 mm as commonly used in construction. Separate sets of friction plates of different breadths together with corresponding U straps would also be provided. In FIG. 11 the anchor is shown fitted to a larger sized rafter 72, using a wide set of U straps 30', 31' and friction plates 31', 32'. However, by bolting as second narrower set of U straps and friction plates (not shown) to the sole plate using apertures 73, 74 in each cutout portion the anchor may be fitted to a smaller sized rafter.

It will thus be appreciated that this invention at least in the form of the embodiments described provides a novel and improved roof anchor for fall-arrest. Clearly however the examples disclosed are only the currently preferred form of the invention and a wide variety of modifications may be made which would be apparent to a person skilled in the art. For example the shape and configuration of the sole and friction plates and connecting straps may be changed according to application or design preference. For example with those installations requiring placement of the anchor along the apex of the roof the sole plate may be altered to a V or any other suitable configuration. Also, while the embodiments described are preferably constructed from high strength steel the invention extends to the use of other suitable materials.

What is claimed is:

1. An anchor for securing a working line to a structure, said anchor including a sole plate adapted for attachment to said working line, at least one friction plate and a connector means whereby in use of the anchor, the sole and friction plates are located against respective opposite sides of a member of said structure and are linked together by said connector means in a manner such that a working line load on the sole plate generates a clamping force between said sole plate and friction plate which resists movement of the anchor by gripping only the outside of said member without any strength reducing penetration thereof and wherein the clamping force produces a clamping action that allows the sole and friction plates to stay parallel with the plane of the structure.

2. The anchor as claimed in claim 1 wherein the sole plate includes an eye bolt for attachment of the working line.

3. A method of fitting an anchor as claimed in claim 1 to a roof structure, said method including the steps of:

procuring said anchor, locating said sole plate and said at least one friction plate opposite one another and against respective opposite sides of a truss or rafter member in a roof structure, attaching said connector means between said sale and friction plates, and attaching said working line to the sole plate.

4. An anchor for securing a working line to a structure, said anchor including a sole plate having an eye bolt adapted for attachment to said working line, said eye bolt adapted for plastic deformation to absorb impact loading and provide visual evidence of said loading, at least one friction plate and a connector means whereby in use of the anchor, the sole and friction plates are located against respective opposite sides of a member of said structure and are linked together by said connector means in a manner such that a working line load on the sole plate generating a clamping force between said sole plate and friction plate which resists movement of the anchor by gripping only the outside of said member without any strength reducing penetration thereof.

5. The anchor as claimed in claim 4 wherein the connector means includes a U shaped strap which in use extends around said at least one friction plate and removable pins or bolts which extend transversely through apertures in said plates to attach said strap.

6. The anchor as claimed in claim 5 wherein a member engaging face of said at least one friction plate is formed with transverse teeth or grooves to facilitate gripping of said member.

7. The anchor as claimed in claim 6 wherein the eye bolt includes an eye portion and a rod portion, said rod portion having a constant cross-section segment and a tapered segment which reduces in cross-section toward the eye portion.

8. The anchor as claimed in claim 7 wherein there are two friction plates and two U shaped straps which in use of the anchor are spaced apart along a length of said member whereby movement of the anchor can be resisted along two directions.

9. The anchor as claimed in claim 8 wherein said anchor is dimensioned to fit a truss or rafter member in a roof structure.

* * * * *